US005632224A

United States Patent [19]

Schneider

[11] Patent Number: 5,632,224

[45] Date of Patent: May 27, 1997

[54] PLATFORM FOR A BOAT TRANSOM

[76] Inventor: Benjamin J. Schneider, 11680 Haylock St., Davisburg, Mich. 48350

[21] Appl. No.: 608,133

[22] Filed: Feb. 28, 1996

[51] Int. Cl.[6] ..... B63B 17/00

[52] U.S. Cl. ..... 114/362

[58] Field of Search ..... 114/361, 362, 114/343; 248/235

[56] References Cited

U.S. PATENT DOCUMENTS

| | | | |
|---|---|---|---|
| D. 236,194 | 8/1975 | Hendrickson . | |
| D. 253,999 | 1/1980 | Richards et al. . | |
| 3,613,137 | 10/1971 | Eccles | 114/362 |
| 3,857,127 | 12/1974 | Hendrickson . | |
| 4,495,883 | 1/1985 | Hoy . | |
| 4,548,155 | 10/1985 | Hegg et al. | 114/362 |
| 4,669,414 | 6/1987 | Molino . | |
| 4,726,317 | 2/1988 | Ritten et al. . | |

OTHER PUBLICATIONS

Huckins, Pembroke, "The Versatile Boardin Stage", Aug. 12, 1958.

*Primary Examiner*—Jesus D. Sotelo
*Attorney, Agent, or Firm*—Dinnin & Dunn, P.C.

[57] ABSTRACT

A swim platform for attachment to a transom of a boat. The platform includes a stop on the upper surface of the platform near the transom. The stop forms a barrier that prevents water skis or other equipment that may slide on the platform when placed on the platform from contacting the transom thus damaging the boat's finish.

10 Claims, 3 Drawing Sheets

PLATFORM FOR A BOAT TRANSOM

BACKGROUND OF THE INVENTION

1. Field of the Invention

The invention relates to a platform for attachment to a transom of a boat. More particularly, the platform includes a stop formed by a raised portion of the platform which prevents objects placed on the platform from striking and damaging the boat's finish.

1. Description of the Related Art

Swim platforms have been used with boats for some time. See for example U.S. Pat. No. 3,613,137. Such platforms typically extend rearwardly at the waterline from the boat transom. The platform facilitates boarding or exiting the boat. Additionally, it provides a seating area for swimmers and enables them to easily enter the boat from the water. Swim platforms are also used by water skiers as a staging area. Water skiers typically don or remove various types of water skis or other water sports equipment such as wake boards or knee boards while on the platform. Regardless of the care taken by the skier, the equipment often slides into the transom of the boat and results in scratching, chipping and other damage to the boat's finish. While such damage typically does not affect performance, it diminishes the boat's appearance, and in some instances, requires the entire surface of the transom to be refinished.

In addition, a number of boat designs include a swim platform integral with the boat hull. See for example U.S. Pat. No. 4,548,155 which illustrates an integral swim platform on which a water ski can be laid. Such an arrangement is especially prone to damage resulting from contact with the boat's finish by water skis or other water sports equipment.

SUMMARY OF THE INVENTION

Accordingly, the present invention is a swim platform having a stop on the upper surface thereof to prevent water skis or other types of water sports equipment from contacting the boat transom and damaging the finish. The stop is formed by a raised layer or section of the platform located at the rear edge of the platform. The stop forms a barrier to prevent water skis or other water sports equipment from sliding on the platform and contacting the transom of the boat, thus damaging the boat's finish.

In the preferred form the platform is made of wood. The stop is formed of an additional layer of wood placed at the rear edge of the platform. When the platform is made of a synthetic material, such as fiberglass or plastic, the stop may be formed integral with the platform during the manufacturing or molding process.

Finally, an additional embodiment of the invention includes a stop formed between a boat hull and an integral swim platform. The stop forms a barrier between the swim platform and the transom of the boat.

DESCRIPTION OF THE PREFERRED EMBODIMENTS

Figure 1:
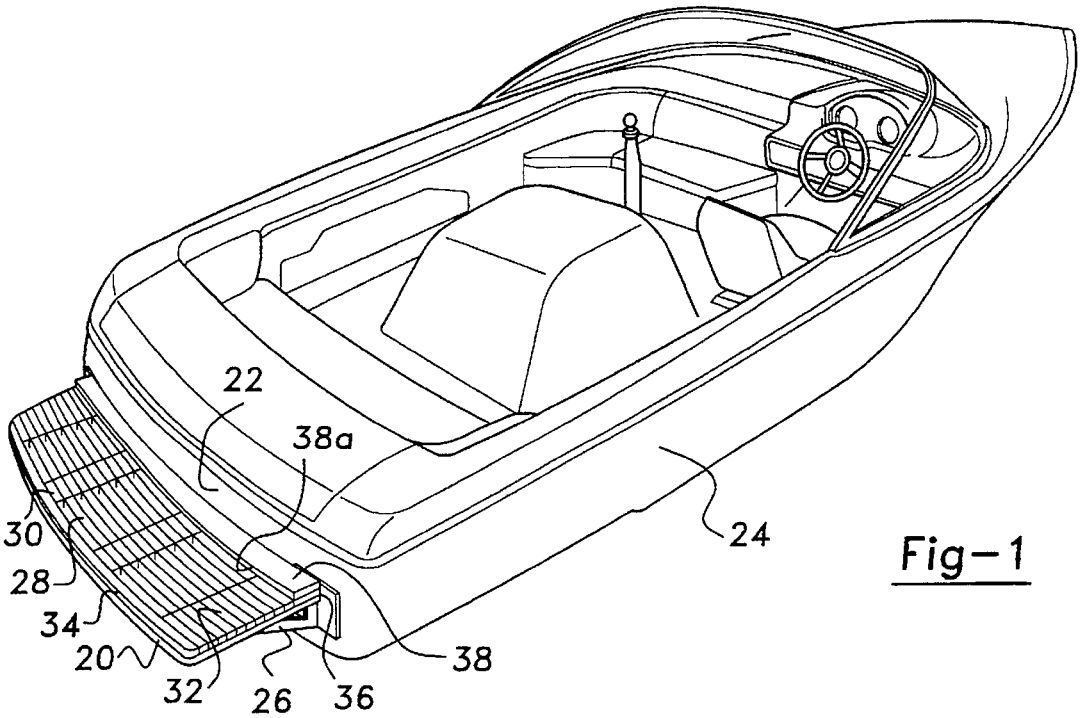
FIG. 1 is a perspective view of a swim platform according to the present invention shown attached to a transom of a boat.
Figure 2:
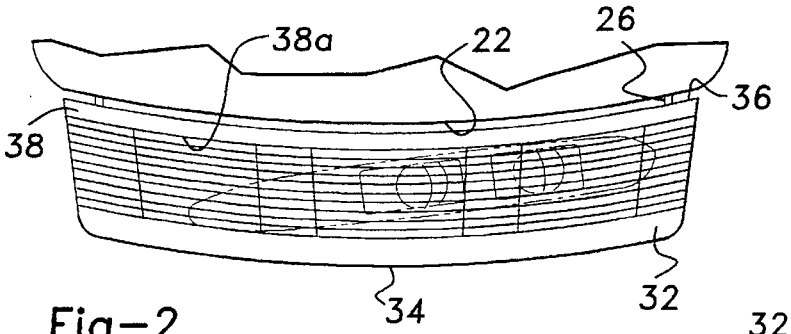
FIG. 2 is a top view of the swim platform of FIG. 1.

Referring now to the drawings, and more particularly, to FIGS. 1–4 thereof, an improved swim platform 20 for attachment to a transom 22 of a boat 24 is shown. The swim platform 20 is secured to the transom 22 by a plurality of mounting brackets 26.

As shown in FIGS. 1–4, the swim platform 20 is a generally planar member formed of a plurality of interwoven individual slats 28 and spacers 30. Wood swim platforms are known in the art having been used for many years. As shown, the slats 28 are typically formed with a curvature that matches or conforms with the curvature of the transom 22. The assembled platform includes an upper surface 32 and front 34 and rear 36 edges. The upper surface 32 is generally a horizontal surface extending rearwardly from the transom 22 at or slightly above the waterline.

A stop 38 is secured to the upper surface 32 at or near the rear edge 36 of the platform 20. The stop 38 includes a stop face **38*a* that forms a barrier to prevent water skis or other equipment, see for example the water ski shown in phantom on FIG. 2, from sliding on the upper surface 32 of the platform 20 and striking the transom 22** thus causing damage to the boat's finish.

Figure 3:
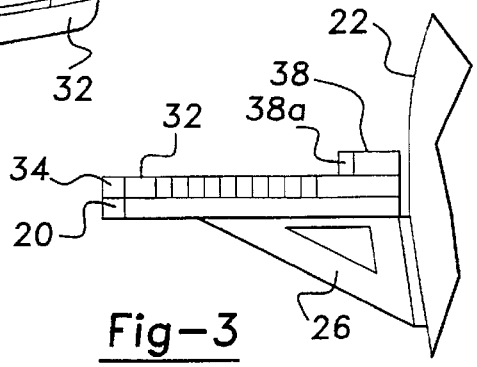
FIG. 3 is a side view of the swim platform of FIG. 1.
Figure 4:
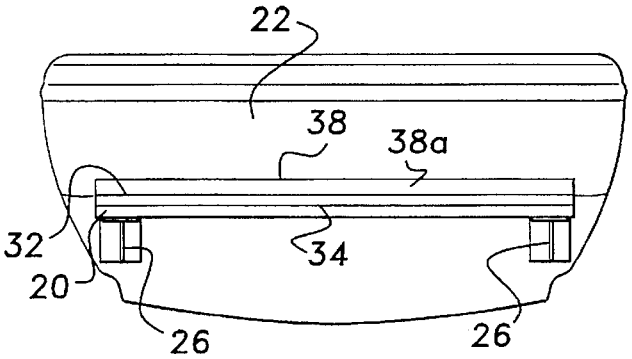
FIG. 4 is a front view of the swim platform of FIG. 1.
Figure 5:
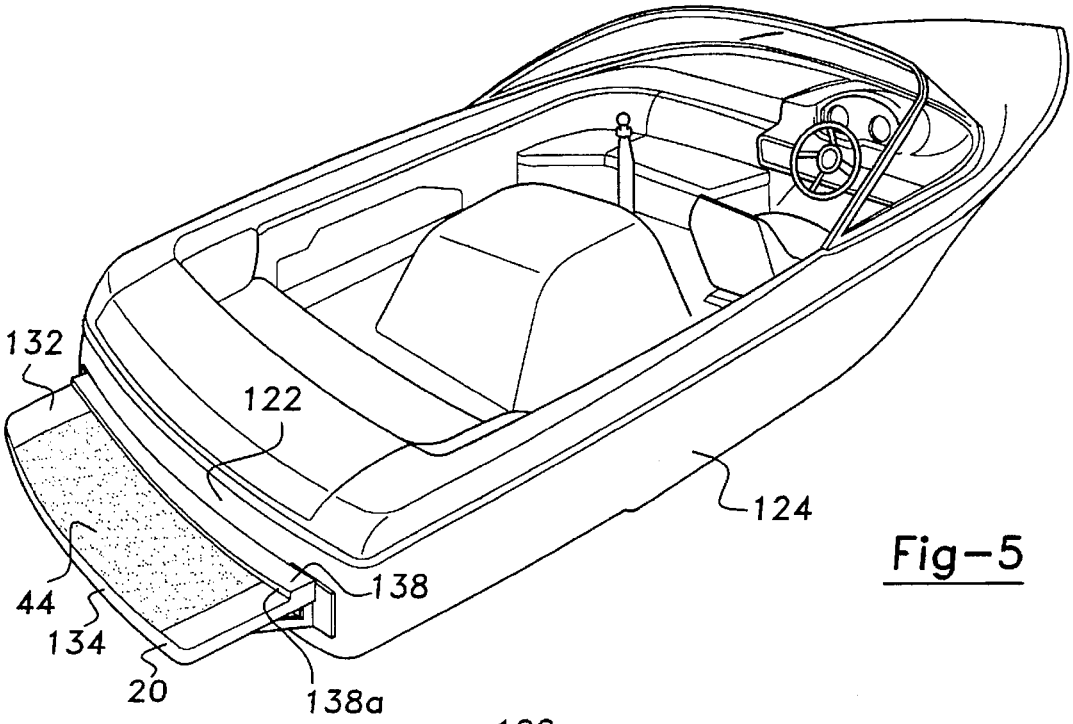
FIG. 5 is a perspective view of a first alternative embodiment of a swim platform according to the present invention shown attached to a transom of a boat.

In the preferred embodiment, the stop 38 is formed of an additional piece of wood, typically the same type of wood used to form the platform 20 shaped to conform to the curvature of the platform 20 and corresponding curvature of the transom 22. Use of the same type of material to form the stop 38 as used to form the platform 20 preserves the appearance of the platform 20 while protecting the boat's finish. As shown in FIG. 3, the height of the stop 38 is approximately the same as one layer of the platform 20. However, the height and width may be varied as necessary to provide a protective barrier between the platform 20 and the transom 22. The stop 38 may be removably attached whereby it can be removed, refinished or replaced should it become damaged. The stop 38 may be attached via screws or some other type of fastener. As disclosed, the stop 38 protects the transom 22 from damage due to contact with water skis or other equipment placed on the swim platform 20 and avoids expensive refinishing costs associated with refinishing or repairing the gelcoat finish on the transom 22.

Figure 6:
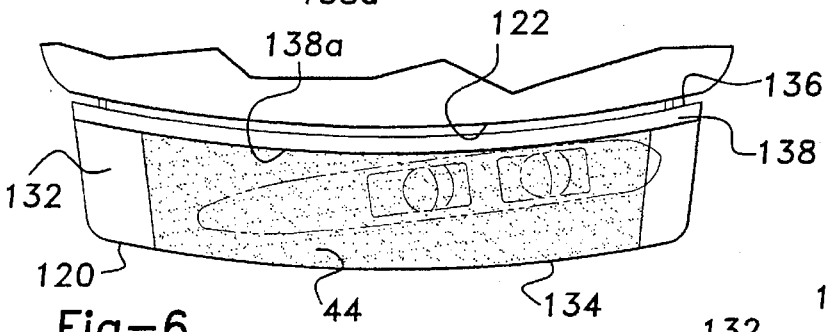
FIG. 6 is a top view of the first alternative embodiment of the swim platform of FIG. 5.
Figure 7:
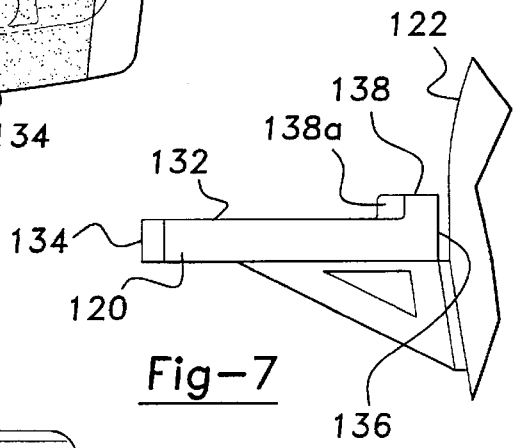
FIG. 7 is a side view of the first alternative embodiment of the swim platform of FIG. 5.
Figure 8:
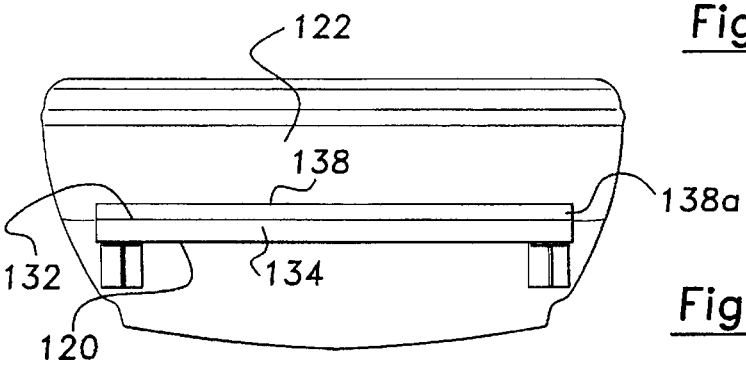
FIG. 8 is a front view of the first alternative embodiment of the swim platform of FIG. 5.
Figure 9:
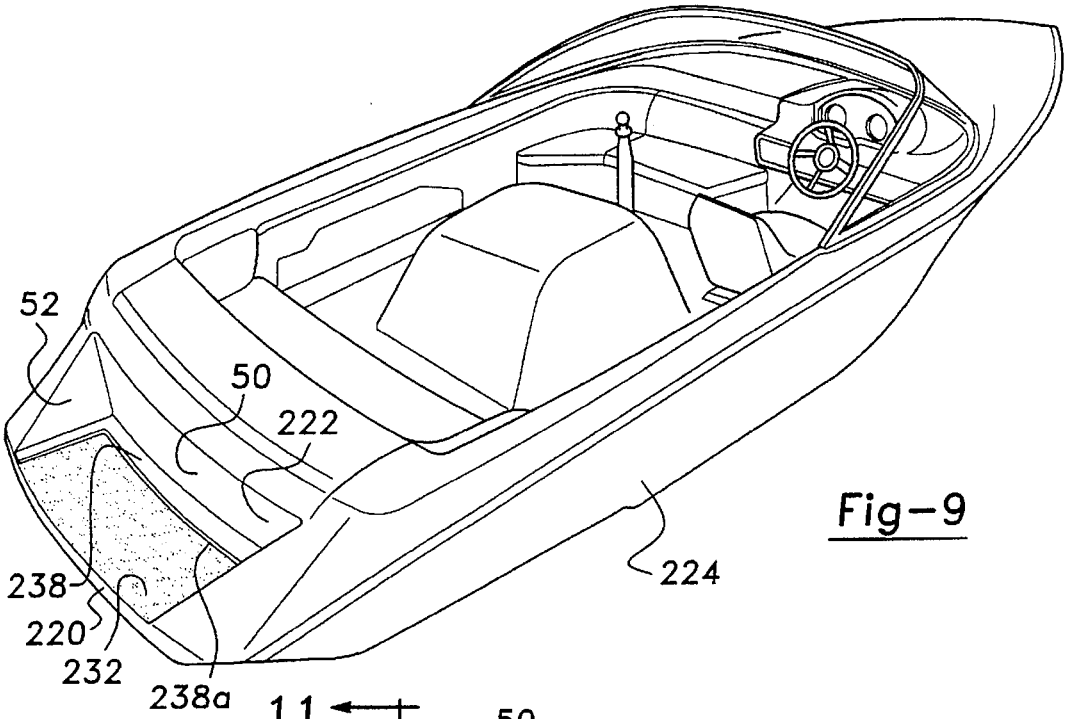
FIG. 9 is a perspective view of a second alternative embodiment of the invention shown in connection with a boat hull having an integral swim platform.
Figure 10:
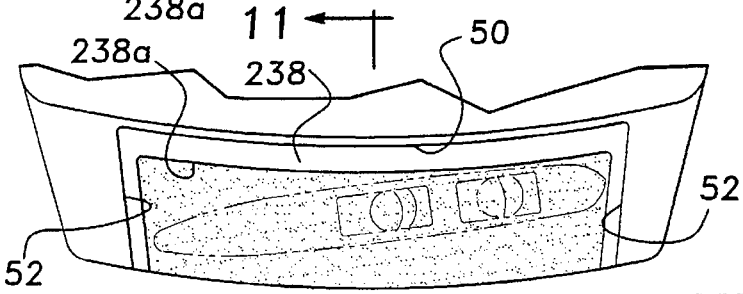
FIG. 10 is a top view of the second alternative embodiment of FIG. 9.
Figure 11:
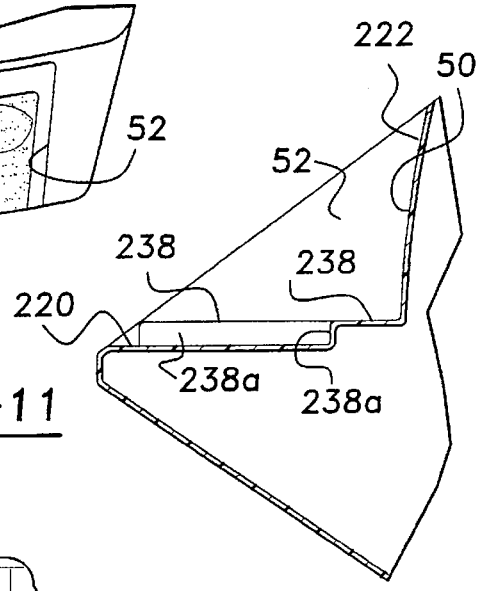
FIG. 11 is a cross-sectional view of the swim platform of FIG. 10 taken along lines 11—11.
Figure 12:
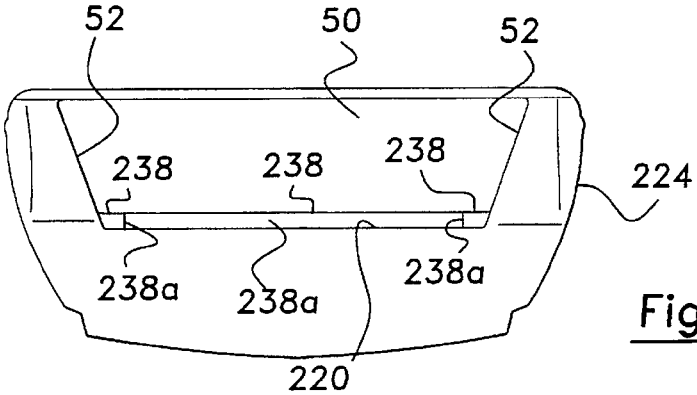
FIG. 12 is a front view of the second alternative embodiment of FIG. 9.

Turning now to FIGS. 5–8, a first alternative embodiment of the present invention is shown. Like parts of the platform 120 have like numbers increased by a factor of 100. In FIGS. 5–8, the swim platform 120, formed of a synthetic material, such as fiberglass or a plastic of suitable composition and rigidity, is attached to a transom 122 of a boat 124. As set forth previously, the platform 120 includes an upper surface 132 and front 134 and rear 136 edges, wherein the rear edge 136 is the edge closest to or adjacent the transom 122. The upper surface 132 often includes a non-skid surface 44, typically formed of a rubberized foam material secured to the upper surface. A stop 138 is formed at or near the rear edge 136 of the platform 120 by raising the overall height of the platform 120 adjacent the rear edge 136. A stop face 138*a* forms a barrier to prevent water skis or other equipment from sliding on the upper surface 132 and striking the transom 122. While the stop 138 shown in FIGS. 5–8 is formed integral with the platform 122, it may also be made of a separate piece of like material and attached to the platform 120. Further, the stop face 138*a* may be covered with a non-skid or resilient material to prevent damage to both water skis or other equipment and the platform 120. As shown in FIG. 6, the stop prevents equipment, such as the water ski shown in phantom, from contacting the transom 122 and damaging the finish.

Turning now to FIGS. 9–12, a second alternative embodiment of the present invention is shown. Like parts of the platform 220 have like numbers raised by a factor of 200. The boat 224 of FIG. 12 includes an integral swim platform 220. As shown, the swim platform 220 extends rearward from the rear face 50 of the transom 222 and between opposite side walls 52 extending rearward and forming a part of the boat 224. A stop 238, formed by a raised portion of the upper surface 232 of the platform 220, extends along the intersection of the rear face 50 and opposite side walls 52 with the platform 220. The stop 238 includes a stop face 238*a* against which water skis or other equipment would contact if slid on the upper surface 232 of the platform 220. The stop face 238*a* may include a covering of a non-skid material to protect the transom 222 and any water ski or other equipment contacting the stop 238.

While the stop 238 is shown integral with the boat 224, it may also be added separately. For example, the swim platform 220 may be formed integral with the boat hull according to the prior art. The stop 238 is then formed of wood or other suitable material shaped to conform to and laid along the intersection of the side walls 52, rear face 50 and platform 220. Such an inlay forms a barrier to prevent contact between any equipment and the gelcoat finish of the boat 224.

In all embodiments, the stop 38 prevents contact between water skis or other water sports equipment placed on the platform 20 and the transom 22 of the boat 24. Preventing contact prevents damage; i.e., scratches, dings and dents to the finished surface of the transom 22 which would otherwise require the transom 22 to be refinished. While only certain embodiments of the present invention have been described, it will be apparent, in light of the disclosure set forth above, that various modifications may be made to the invention without departing from the spirit and scope of the present invention.

What is claimed is:

1. A platform for attachment to a transom of a boat comprising:

a plurality of brackets secured to said platform wherein said brackets support said platform and attach said platform to said transom;

said platform including an upper surface and front and rear edges, said rear edge being that edge of said platform closest to said transom; and a stop secured to said upper surface of said platform, said stop comprises a raised portion of the upper surface of said platform, said raised portion defining a stop face, said stop extending along the entire length of the rear edge of said platform adjacent to said transom.

2. A platform as set forth in claim 1 wherein said platform comprises a plurality of wooden slats and spacers interwoven to form said platform, and said stop formed of an additional wood slat of a shape conforming to the contour of the platform secured to the upper surface of said platform adjacent said rear edge.

3. A platform as set forth in claim 2 wherein said stop is removably secured to said platform and may be removed without disturbing the integrity of said platform.

4. A platform as set forth in claim 1 wherein said stop is formed integral with said platform.

5. A platform as set forth in claim 1 wherein said platform comprises a unitary member made of a synthetic material.

6. A platform as set forth in claim 5 wherein said stop is removably secured to said platform and may be removed without disturbing the integrity of said platform.

7. A platform as set forth in claim 5 wherein said stop is formed integral with said platform.

8. A platform formed integral with a boat transom comprising:

a pair of opposite side walls extending rearwardly from said transom and a rear face forming a portion of said transom wherein the platform extends rearwardly from said rear face and between said side walls, the platform, rear face and opposite side walls forming an intersection; and a stop extending along said platform adjacent said intersection, said stop comprises a raised portion of the upper surface of the platform wherein said raised portion defines a stop face, said stop extends along the entire length of said intersection between the platform, said rear face and said sidewalls.

9. A platform as set forth in claim 8 wherein said stop is removably secured to said platform and may be removed without disturbing the integrity of said platform.

10. A platform as set forth in claim 8 wherein said stop is formed integral with said platform.

* * * * *